United States Patent [19]

Daugirda

[11] 4,415,020

[45] Nov. 15, 1983

[54] VESSEL CONSTRUCTION EMPLOYING MULTIPLE INTERNAL HEAT EXCHANGE TUBES

[75] Inventor: Paul G. Daugirda, Evergreen Park, Ill.

[73] Assignee: Rheem Manufacturing Company, New York, N.Y.

[21] Appl. No.: 280,447

[22] Filed: Jul. 6, 1981

Related U.S. Application Data

[62] Division of Ser. No. 116,272, Jan. 28, 1980, abandoned.

[51] Int. Cl.[3] ..... F28F 9/16

[52] U.S. Cl. ..... 165/76; 165/133; 165/134 R; 165/146; 165/158

[58] Field of Search ..... 165/158, 76, 175, 133, 165/147, 134, 146

[56] References Cited

U.S. PATENT DOCUMENTS

| | | | |
|---|---|---|---|
| 191,868 | 6/1877 | Lowe | 165/158 |
| 970,561 | 9/1910 | Scaramuzza | 165/158 |
| 3,268,989 | 8/1966 | Erwin et al. | 165/133 X |

FOREIGN PATENT DOCUMENTS

| | | | |
|---|---|---|---|
| 571330 | 5/1924 | France | 165/158 |
| 5662 | of 1908 | United Kingdom | 165/158 |
| 505127 | 5/1939 | United Kingdom . | |
| 666131 | 2/1952 | United Kingdom . | |
| 953021 | 3/1964 | United Kingdom . | |
| 1000238 | 8/1965 | United Kingdom . | |
| 1105311 | 3/1968 | United Kingdom . | |
| 1192381 | 5/1970 | United Kingdom | 165/147 |
| 1538420 | 1/1979 | United Kingdom | 165/70 |

*Primary Examiner*—Sheldon J. Richter

*Attorney, Agent, or Firm*—Allegretti, Newitt, Witcoff & McAndrews, Ltd.

[57] ABSTRACT

A hot water heater tank is formed from a cylindrical body or tube and a header subassembly. The header subassembly includes first and second headers sized to fit in separately sized sections of the body of the tank. The subassembly, comprising the headers and interconnecting heat exchange tubes, is coated with a protective ceramic material prior to insertion into the cylindrical body of the tank.

3 Claims, 7 Drawing Figures

VESSEL CONSTRUCTION EMPLOYING MULTIPLE INTERNAL HEAT EXCHANGE TUBES

This is a division of application Ser. No. 116,272, filed Jan. 28, 1980 now abandoned.

BACKGROUND OF THE INVENTION

This invention relates to an improved method of manufacture of vessels which employ multiple internal heat exchange tubes.

Historically the manufacture of vessels which employ multiple internal heat exchange tubes has presented problems of warpage due to buildup of stresses as a result of temperature differences encountered during the welding or brazing process utilized to attach the tubes to headers forming the vessel. Such warpage is a significant problem in vessels which have precoated parts particularly where the precoating material is a ceramic or porcelain material of a type which insures corrosion protection.

That is, a common practice in the manufacture of vessels is to take a tubular body and weld headers or end plates to the end of the body thereby forming an enclosed tank. The interior of the tank is then coated with a ceramic or porcelain material for corrosion protection. Subsequently, heat exchange tubes are inserted through openings in the end plates of the tank or headers. These heat exchange tubes are then welded to the headers. The welding process often causes warpage of the header and the tube ends resulting in cracking of the protective coating. This, in turn, exposes the metal surface to corrosive activity, particularly in a water heater tank assembly.

The present invention constitutes a method of manufacture as well as an assembly which seeks to overcome the problem of degradation of the protective coating material on the inside of a tank or vessel of the type which has multiple internal heat exchange tubes.

SUMMARY OF THE INVENTION

The method of the present invention includes the initial step of manufacture of a subassembly comprising heat exchange tubes connected between headers. This subassembly may then be coated with a corrosion resistant material. The subassembly is next inserted into a tube or vessel body for formation of the final tank or vessel. One of the headers is sized smaller than the other header. The tube or body is shaped and sized to be compatible with the respective headers.

Thus, it is an object of the present invention to provide an improved method of manufacture of a vessel or tank which employs multiple internal heat exchange tubes.

A further object of the present invention is to provide an improved method of manufacture of a vessel wherein the likelihood of degradation of a protective coating on the interior of the vessel is diminished.

Still another object of the present invention is to provide an improved method of manufacture and construction for a vessel which is economic and will result in an improved number of acceptable vessels being constructed during a manufacturing process.

These and other objects, advantages and features of the present invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

The vessel of the present invention includes a subassembly comprised of first and second headers at 10 and 12 which are interconnected by a plurality of heat exchange tubes 14. The subassembly is then inserted into a vessel body or tank 16 and welded or brazed into position.

Figure 1:
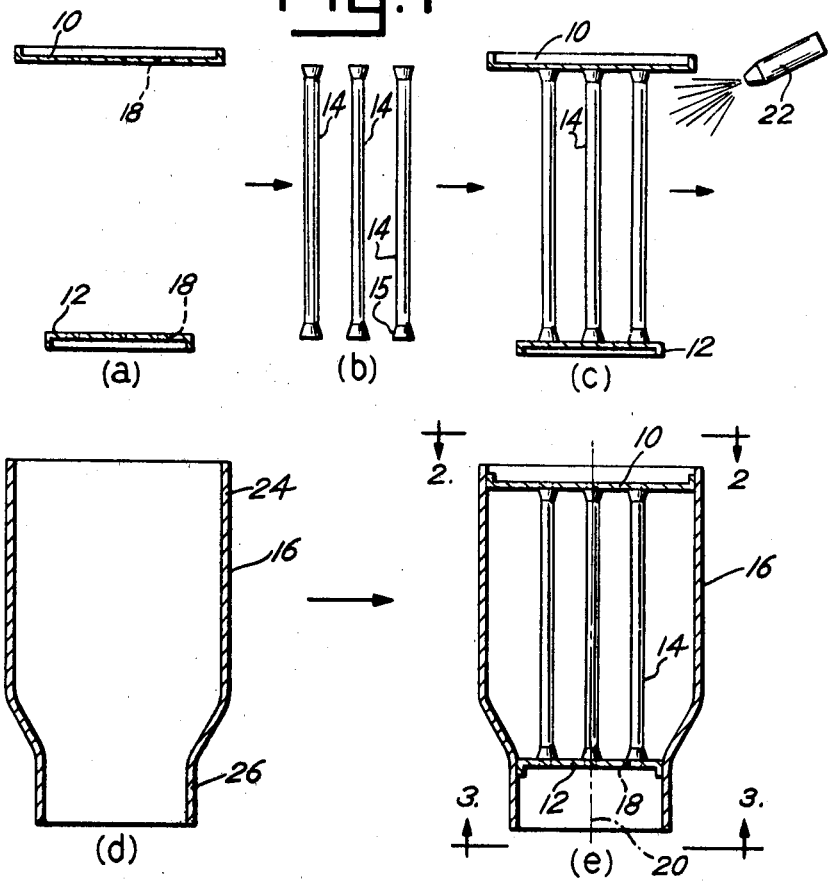
FIG. 1, parts (a) through (e) comprise a side elevation illustrating the steps comprising the method of the invention and the component parts of a vessel.

As shown in FIG. 1, parts (a)–(c), the sequence of operations of steps in the manufacture of the completed vessel includes forming the headers 10, 12 so that they have substantially the same shape. However, one of the headers 12 is formed smaller than the other header 10. The headers 10 and 12 include a plurality of openings 18 for receipt of the tubes 14. Openings 18 in the headers 10, 12 are adapted to receive the flared ends 15 of tubes 14 and the ends 15 of the tubes 14 are then flared. The tubes 14 are then welded or brazed or otherwise metallurgically affixed to the headers 10, 12. Preferably the tubes 14 are arranged in parallel array so that they will ultimately be parallel to a vertical axis 20 of the assembled vessel.

The subassembly comprising the headers 10, 12 and the tubes 14 may then be coated as shown in FIG. 1 part (c) by a protective coating material such as a ceramic or porcelain material. A coating applicator 22 is schematically illustrated in FIG. 1 part (c) for applying the coating on the subassembly and particularly on the portion of the subassembly which will be on the inside of the final vessel construction.

Figure 2:
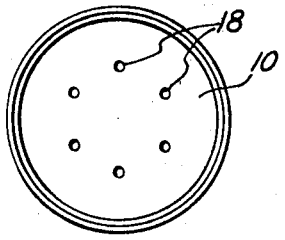
FIG. 2 is a top plan view of the assembled vessel taken along the line 2—2 in FIG. 1.
Figure 3:
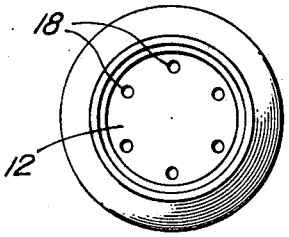
FIG. 3 is a bottom plan view of the assembly vessel taken along the line 3—3 in FIG. 1.

The next steps are illustrated in FIG. 1 parts (c) and (d). The tank body 16 has a cross sectional shape adapted to receive the headers 10, 12. The tank body 16 is divided into an upper section 24 which will receive the header 10 and a lower section which will receive the header 12. The dimensional difference between the sections 24 and 26 is small. However, the dimension difference insures that the header assembly will be properly inserted and retained in the tank body 16. The interior of the tank body 16 may be precoated with a protective material such as a ceramic or porcelain material. Then, upon insertion of the subassembly as shown in part (e) of FIG. 1, the headers 10 and 12 may be welded or brazed or otherwise metallurgically affixed to the tank body 16. FIGS. 2 and 3 are end views of the final assembled vessel.

Typically, the finished vessel as depicted in FIG. 1, part (e) comprises part of a hot water heater assembly. Water is heated in the vessel by a gas burner positioned beneath the header 12. Hot gases flow through heat exchange tubes 14.

The shape or size of the body 16 in the final vessel assembly may be varied. That is, the headers may be rectangular as may be the tank body. One header may be rectangular and the other header may have another shape. Various other combinations are possible. Importantly, a subassembly comprising the headers 10, 12 and tubes 14 is fabricated and coated thereby allowing inspection of the coated surface prior to final assembly with the body 16. With the method of the present invention, the deterioration of the interior vessel coating material is prevented. Thus, the scope of the invention is to be limited only by the following claims and their equivalents.

What is claimed is:

1. An improved vessel in a water heater tank construction, the improvement comprising, in combination:

a plurality of open heat exchange tubes having terminal ends;

first and second opposed headers including opposed openings for receipt of the tubes; means for affixing the tubes in sealed relationship with the header and for retention thereof in generally parallel sealed array, each end of a tube being metallurgically affixed to one of the headers, said headers having an identical configuration and a separate uniform constant transverse dimension, the first one of said headers defining a uniform constant transverse dimension smaller that the transverse dimension of the second header, said assembled tubes and headers being coated with a protective material to define a header subassembly; and a tank body having a uniform cross sectional interior shape along the length of the body, said cross sectional shape identical to the shape of the headers for slidable and adjustable receipt of the headers, said body having two transverse dimension regions, one of said regions having a uniform constant transverse dimension to slidably receive the first header and the other region having a different uniform constant transverse dimension to slidably receive the second header, said first header being slidably positioned within the one region and metallurgically affixed to the body in the one region and the second header being slidably positioned within the second region and metallurgically affixed to the body in the second region.

2. The vessel of claim 1 wherein said protective material is a ceramic material.

3. The vessel of claim 1 wherein said headers are circular in shape and said tank body has a compatible shape.

* * * * *